US008066164B2

(12) United States Patent
Gregory

(10) Patent No.: US 8,066,164 B2
(45) Date of Patent: Nov. 29, 2011

(54) BACKPACK HAVING AUTO-ADJUSTING WAISTBELT

(75) Inventor: Wayne B. Gregory, Fallbrook, CA (US)

(73) Assignee: Gregory Mountain Products, LLC, Sacramento, CA (US)

( * ) Notice: Subject to any disclaimer, the term of this patent is extended or adjusted under 35 U.S.C. 154(b) by 1115 days.

(21) Appl. No.: 11/148,706

(22) Filed: Jun. 8, 2005

(65) Prior Publication Data

US 2006/0289589 A1 Dec. 28, 2006

(51) Int. Cl.
*A45F 3/00* (2006.01)

(52) U.S. Cl. ..... 224/631; 224/637; 224/628; 224/641

(58) Field of Classification Search ..... 224/631, 224/637, 628, 343, 344, 262, 641, 663, 660, 224/630, 638, 907
See application file for complete search history.

(56) References Cited

U.S. PATENT DOCUMENTS

| | | | | |
|---|---|---|---|---|
| 4,099,657 | A | 7/1978 | Zufich | |
| 4,189,076 | A | 2/1980 | Zufich | |
| 5,064,108 | A | 11/1991 | Headley | |
| 5,090,604 | A | 2/1992 | Howe | |
| 5,114,059 | A | 5/1992 | Thatcher | |
| 5,429,287 | A | 7/1995 | Frano | |
| 5,449,102 | A | 9/1995 | Sason | |
| 5,451,121 | A | 9/1995 | Seligman | |
| 5,564,612 | A | 10/1996 | Gregory | |
| 5,725,139 | A | 3/1998 | Smith | |
| 5,742,988 | A | 4/1998 | Swetish | |
| 5,954,250 | A | 9/1999 | Hall et al. | |
| 5,954,253 | A | 9/1999 | Swetish | |
| 6,015,076 | A | 1/2000 | Pennington | |
| 6,024,265 | A | 2/2000 | Clements | |
| 6,290,111 | B1 * | 9/2001 | Hedenberg et al. | 224/262 |
| 6,607,108 | B2 | 8/2003 | Mydans | |
| 6,634,533 | B2 | 10/2003 | Thompson et al. | |
| 2002/0108982 | A1 | 8/2002 | Mydans | |
| 2002/0145028 | A1 | 10/2002 | Moore | |
| 2003/0034372 | A1 | 2/2003 | Thompson et al. | |
| 2003/0121945 | A1 | 7/2003 | Lemanski, II | |
| 2004/0065704 | A1 | 4/2004 | Penny et al. | |
| 2004/0077983 | A1 | 4/2004 | Reinecke et al. | |
| 2005/0092802 | A1 * | 5/2005 | Maley | 224/628 |
| 2006/0163305 | A1 * | 7/2006 | Tong | 224/628 |

OTHER PUBLICATIONS

2005 Gregory Dealer Workbook, Adjust-A-Cant, p. 5, 2 pages.

* cited by examiner

*Primary Examiner* — Justin Larson
*Assistant Examiner* — Corey Skurdal
(74) *Attorney, Agent, or Firm* — Trent Baker; Baker & Associates PLLC

(57) ABSTRACT

A backpack is provided including a waistbelt having a dual-axis canting system. The waistbelt includes a central support and left and right belt portions that are pivotally coupled to the central support, extending around the sides of the user. The belt portions are configured to pivot about corresponding pivot axes, spaced apart from each other. The belt portions can freely pivot with respect to the central support to accommodate the user's body shape and the user's movement.

12 Claims, 5 Drawing Sheets

BACKPACK HAVING AUTO-ADJUSTING WAISTBELT

BACKGROUND OF THE INVENTION

The invention relates generally to backpacks and, more particularly, to backpacks having a waistbelt.

Backpacks have long been used for carrying heavy, bulky loads. Over the years, backpacks of various configurations have been made, including packs having external frames, internal frames, and those without frames. External-frame backpacks typically include interconnected metal bars, forming a relatively rigid structure. A pack body, typically of nylon or canvas, is secured generally within the confines of the frame and, as such, is relatively spaced apart from the back of the user. Internal-frame backpacks typically include internal stays disposed within pockets of the body of the backpack, allowing the backpack to be positioned more closely to the back of the user. Frameless backpacks typically exclude rigid support structures, allowing the pack to conform to the user.

Regardless of type of backpack, much effort has been made to distribute the weight of the load evenly onto the user. The ability to carry heavy loads in relative comfort depends in great part upon the placement and transfer of the load. To that end, backpacks often include a waistbelt to transfer some of the load onto hips and lumbar area of the user. Typically, the belt is attached to a lower portion of the backpack, extending about the hips of the user.

Traditionally, waistbelts have been provided as a padded belt having an attachment point to the sack of the backpack in a rear portion and a buckle in a front portion. Such belts typically were formed of padding material and fabric and were cinched around the user. The belts aided in distributing load onto the hips. However, as a user moved, the weight tended to shift excessively, overloading concentrated areas on the user, causing discomfort. Moreover, such belts tended to be shaped for a generic body type.

More recently, certain waistbelts have been configured with adjustments to better conform to a range of body types to include different hip-to-waist angles. In one example, a belt includes two lateral arms that extend from a support of the backpack and wraps around the user's hips. The arms can be set at three different angle settings to accommodate different hip-to-waist angles, by attaching screws in one of three different positions provided cooperatively by the support and the arms. Once set, the lateral arms are fixed in at that angle. Thus, as the user moves the load still tends to shift relative to the hips, as previously discussed.

It should, therefore, be appreciated that there remains a need for a backpack that accommodates wide range of body types and provides effective load distribution. The present invention fulfills this and other needs.

SUMMARY OF THE INVENTION

The invention provides a backpack including a waistbelt having a dual-axis canting system. The waistbelt includes a central support and left and right belt portions that are pivotally coupled to the central support, extending around the sides of the user. The belt portions are configured to pivot about corresponding pivot axes, spaced apart from each other. The belt portions can freely pivot with respect to the central support to accommodate the user's body shape and the user's movements.

In a detailed aspect of an exemplary embodiment, the pivot axes are disposed adjacent to a lower edge of the central support and to a lower edge of the corresponding belt portion.

The waistbelt can further include a catch mechanism configured to maintain pivotal movement of the left and the right belt panels within a bounded range. For example, for each belt panel, the catch mechanism can include a pin extending from a belt panel disposed for movement within an arced slot defined by the central support.

In an exemplary embodiment, the backpack includes a load support structure attached operatively coupled to the central support of the waistbelt. The load support structure can include a stay attached to the central support of the waistbelt, extending along the first side of the pack body. The load support structure of the backpack can also include an upper portion adjacent to the user's scapulas, when the backpack is worn. In various other embodiments, the load support structure can include a framesheet coupled to the first side of the pack body. The framesheet can further include a lower portion that contributes to the central support.

In another detailed aspect of an exemplary embodiment, the central support of the waistbelt includes a first support panel defining two pivot points for the belt portions, disposed outside the pack body, and a second support panel disposed inside the pack body, coupled to the first support panel such that a portion of the pack body is captured between the first and the second support panels.

In yet another detailed aspect of an exemplary embodiment, the backpack includes a pair of shoulder straps, each having an upper end coupled to the upper portion of the load support structure and a lower end coupled to the central support of the waistbelt.

In yet another detailed aspect of an exemplary embodiment, the belt portions each include a side panel formed of rigid material pivotally coupled to the central support, defining the corresponding pivot axis. The belt portions further include a padded sleeve disposed about the side panel.

For purposes of summarizing the invention and distinguishing it over the prior art, certain advantages of the invention have been described herein. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment disclosed.

BRIEF DESCRIPTION OF THE DRAWINGS

Embodiments of the present invention will now be described, by way of example only, with reference to the following drawings in which.

DETAILED DESCRIPTION OF THE PREFERRED EMBODIMENTS

Figure 1:
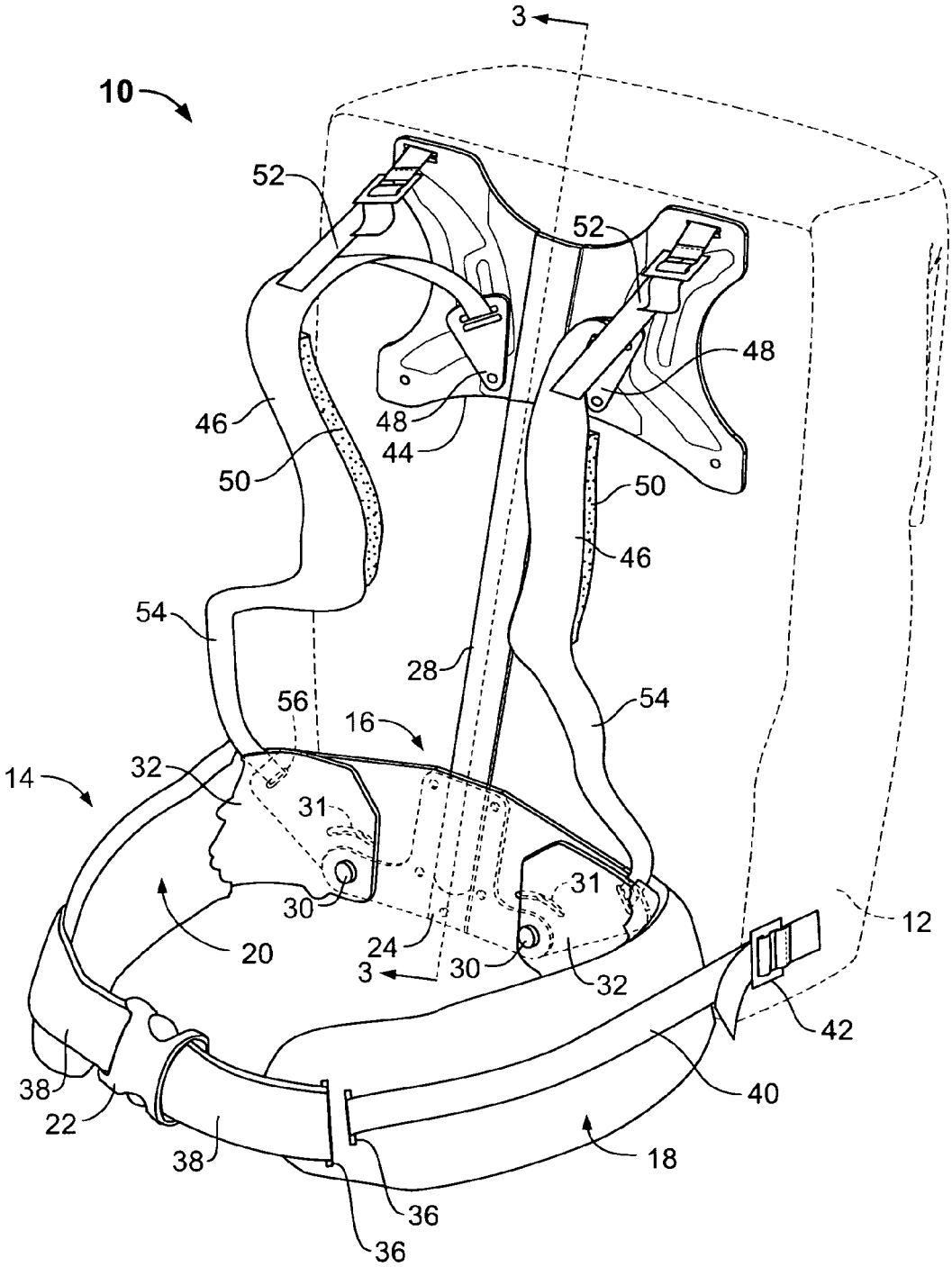
FIG. 1 is a perspective view of a backpack in accordance with the invention, depicting a waistbelt having a dual-axis canting system.

With reference to the drawings, and particularly FIG. 1, there is shown a backpack 10 including a sack 12 and a waistbelt 14 having a dual-axis canting system. The waistbelt includes a central support 16 and left and right belt portions 18, 20 that extend around the sides of the user and couple in the front of the user via a buckle 22. The belt portions are pivotally coupled to the central support to accommodate the user's hip angle. Moreover, the belt portions can pivot freely to articulate as the user moves, maintaining effective load distribution.

Figure 2:
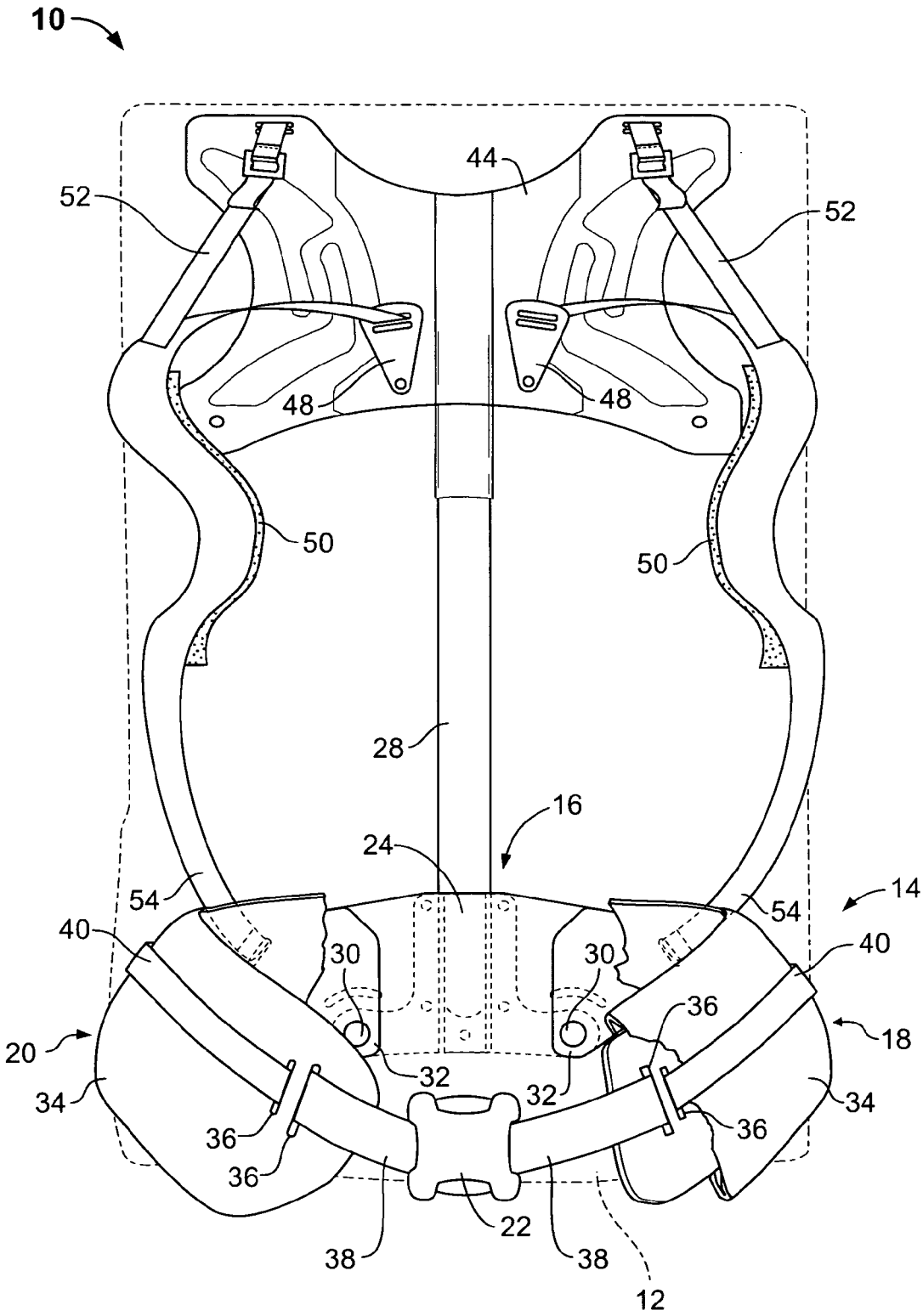
FIG. 2 is a front elevational view of the backpack of FIG. 1, depicting the sack in phantom, exposing a load support structure of the backpack and a central support of the waistbelt.
Figure 3:
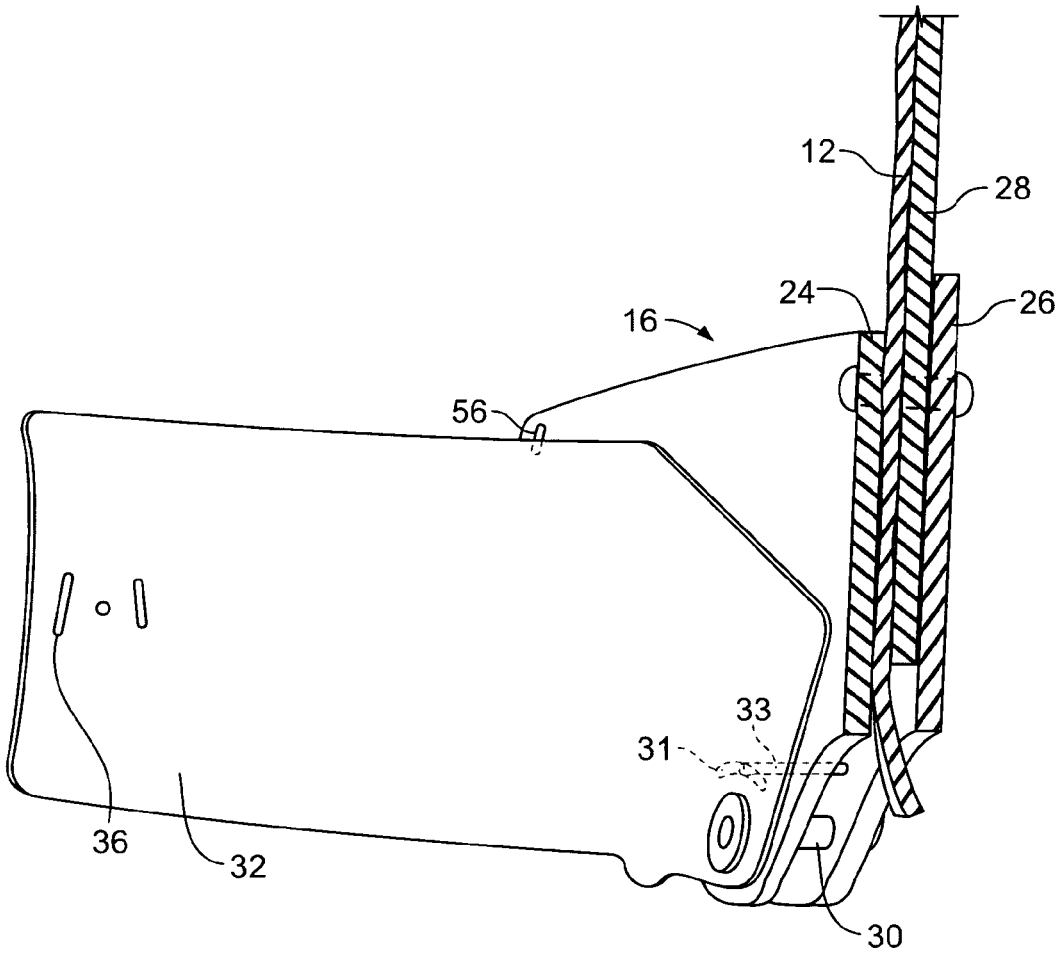
FIG. 3 is a cross-sectional view, taken along line 3-3, of the backpack of FIG. 1, depicting the central support and a central stay.

With reference to FIG. 2, the central support 16 includes an outer support panel 24 and an inner support panel 26 coupled to each other, capturing a central stay 28 as well as a portion of the sack 12 between them. The panels are coupled together via metal rivets. Both the outer support panel and the inner support panel are formed of a relatively strong material such as high-density polyethylene (HDPE), as a unitary piece. In other embodiments, various other materials having sufficient structural strength and flexibility can be used, e.g., metals; composites, e.g., glass-fiber composites; and plastics, e.g., thermoplastics and/or thermosets singly or in combination.

Figure 4:
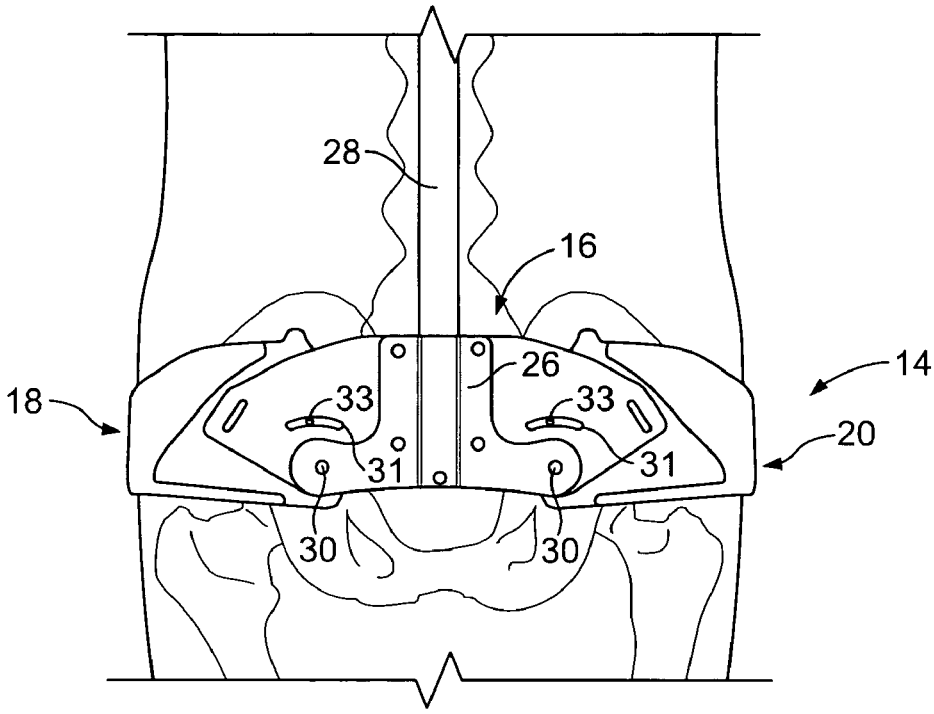
FIG. 4 is a simplified rear elevational view of the waistbelt and a central stay of the backpack of FIG. 1 disposed about a user, depicting the relative alignment of the waistbelt on a user having a first body type.
Figure 5:
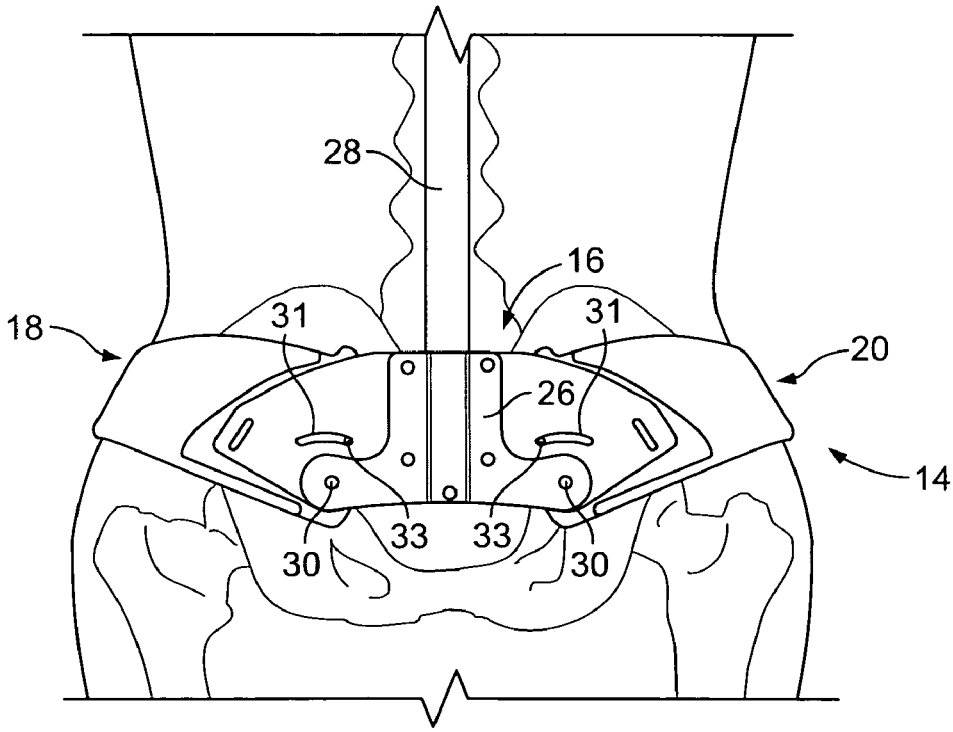
FIG. 5 is a simplified rear elevational view, similar to FIG. 4, depicting the relative alignment of the waistbelt on a user having a second body type.

The outer support panel 24 defines two apertures for receiving pivots 30, defining pivot axes for the belt portions 18, 20. The pivots are generally aligned with the user's hips and are disposed adjacent to lower edges of the outer support panel and the corresponding belt portions. As best seen in FIGS. 4 and 5, with the waistbelt is secured about the user, the belt portions can rotate to accommodate the user's body shape, which is of particular benefit to those with more rounded hips.

Figure 6:
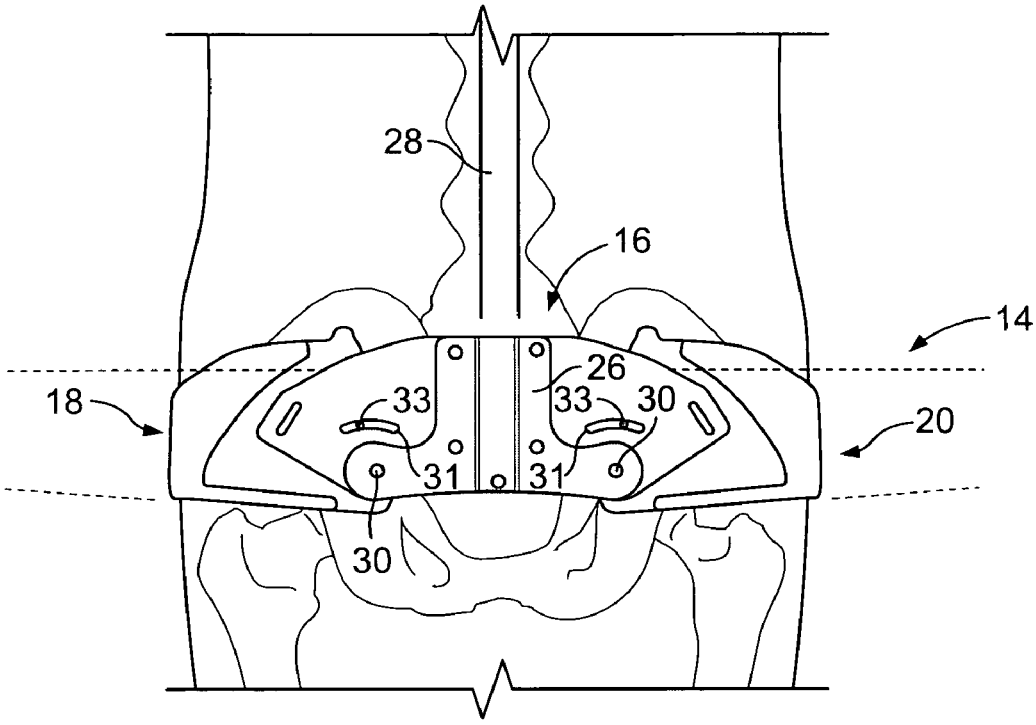
FIG. 6 is a simplified rear elevational view, similar to FIG. 4, depicting the relative alignment of the waistbelt and central stay with the user standing at rest.
Figure 7:
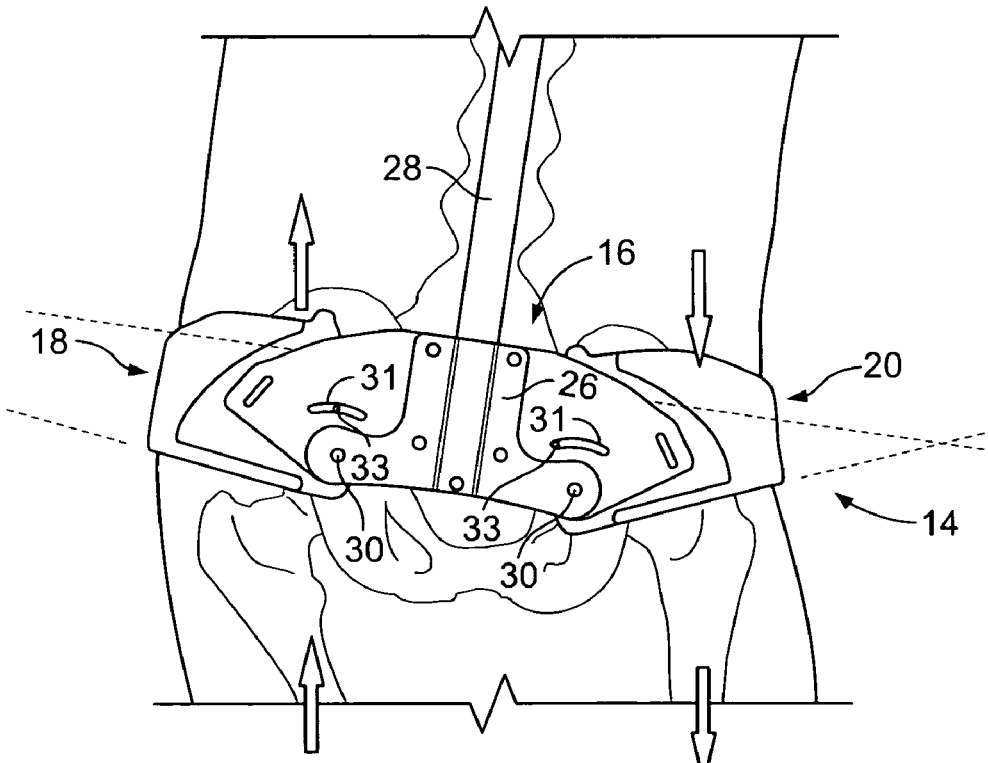
FIG. 7 is a simplified rear elevational view, similar to FIG. 4, depicting the relative alignment of the waistbelt and central stay with the user's torso angled relative to the hips.

With reference now to FIGS. 6 and 7, the waistbelt 14 maintains the central stay 28 in alignment with the user's spine even while the user moves. FIG. 6 depicts the user standing at rest. In this position, the user's spine is generally upright with respect to the hips, with the central stay aligned with the spine. As the user moves, the user's spine angle changes, such as shown in FIG. 7. By relative pivoting of the central support 16 and the belt portions 18, 20, the central support maintains the central stay aligned with the spine. In this manner, the waistbelt enables free movement of the user without inhibiting even load distribution.

In the exemplary embodiment, the waistbelt 14 further include a catch mechanism configured to maintain pivotal movement of the left and the right belt portions 18, 20 within a bounded range. The outer panel 24 of the central support 16 defines two arced slots 31 that provide a bounded range of movement. Each of the side panels 32 include a pin 33 that extends into the corresponding arc slot. As shown in FIGS. 4-7, the pins allow the belt portions to pivot freely within the range defined by the arced slot.

With reference again to FIG. 2, the central support 16 is operatively coupled to the overall load support structure of the backpack. More particularly, the central stay 28 extends between the central support and an upper back panel 44, providing structured support to the backpack. Thus, with the backpack loaded, a substantial portion of the load weight is distributed onto the weightbelt via the central stay.

In the exemplary embodiment, one stay 28 is used. Other embodiments are contemplated having multiple stays. Alternatively, stays can be excluded, for example, in packs configured for comparatively light loads. In yet other embodiments, the waistbelt can be configured for use in backpacks having various other load support structures, e.g., external frames, internal frames, and framesheets.

The upper back panel 44 formed of relatively strong material such as high-density polyethylene (HDPE), as a unitary piece. In other embodiments, various other materials having sufficient structural strength and flexibility can be used, e.g., metals; composites, e.g., glass-fiber composites; and plastics, e.g., thermoplastics and/or thermosets singly or in combination.

The belt portions 18, 20 each include a side panel 32 disposed in a padded sleeve 34. The panels are configured to strengthen the belt portions. The pivots 30 extend through apertures of each of the panels, attaching belt portions to the central support 16. The side panels 32 define slots 36 from which adjustable webbing straps 38 extend to the buckle 22. In the exemplary embodiment, the panels are formed as a unitary piece of plastic; however, various other materials having sufficient structural strength and flexibility can be used. The padded sleeves are attached to the panel via snaps located adjacent to the pivot point and extend beyond the panels.

The backpack 10 further includes lower support webbing straps 40 that extend from the slots to attachments, locking ladders 42, located along a lower edge of the sack. The lower support straps can be adjusted to have the sack conform about the user in proximity to the waistbelt 14, inhibiting excessive shifting of the load.

With reference again to FIG. 1, the shoulder straps 46 are attached at upper ends to the back panel 44 via pivoting strap attachments 48. The shoulder straps each include an intermediate padded portion 50 having an ergonomic shape. In the exemplary embodiment, as the padded portions crests over the shoulder, they curve inwardly toward the sternum of the user, then curve outwardly towards the lower attachment points, to conform to the user. A shoulder stabilizing strap 52 extends from an intermediate region of each padded portion 50 to a fixed position to the upper back panel 44, aiding proper load distribution.

The shoulder straps include lower webbing straps 54 that extend between the padded portion and slots 56 defined the outer support panel 24 of the central support. Thus, the shoulder straps are attached at their upper ends to the upper panel and at their lower ends to the central support of the waistbelt and, as previously mentioned, the upper panel and the central support are operatively coupled via the central stay. This configuration further facilitates effective load distribution on to the user.

It should be appreciated from the foregoing that the invention provides a backpack including a waistbelt having a dual-axis canting system. The waistbelt includes a central support and left and right belt portions that are pivotally coupled to the central support, extending around the sides of the user. The belt portions are configured to pivot about corresponding pivot axes, spaced apart from each other. The belt portions can freely pivot with respect to the central support to accommodate the user's body shape and the user's movement.

Although the invention has been disclosed in detail with reference only to the exemplary embodiments, those skilled in the art will appreciate that various other embodiments can be provided without departing from the scope of the invention. Accordingly, the invention is defined only by the claims set forth below.

What is claimed is:

1. A backpack, comprising:

a pack body configured to be disposed on a user's back and having a first side located adjacent to the user's back, when the backpack is worn; and a waistbelt having a dual-axis canting system, the waistbelt comprising:

central support coupled to a lower portion of the pack body, wherein the central support includes a first support panel providing structural rigidity and defining two independent pivot points for a left and right belt portions, the first panel disposed outside the pack body, and a second support panel providing structural rigidity and disposed inside the pack body and coupled to the first support panel, capturing a central stay and a portion of the pack body between the first and second support panel, wherein the central stay provides structural rigidity, a left belt portion pivotally coupled to the central support, defining a left pivot axis, the left belt portion configured to extend around a left side of the user, a right belt portion pivotally coupled to the central support, defining a right pivot axis spaced apart from the left pivot axis, the right belt portion configured to extend around a right side of the user, a catch mechanism configured to maintain pivotal movement of the left and the right belt portions within a bounded range, the catch mechanism comprising a pin extending from a belt portion disposed for movement within an arced slot defined by the central support, and wherein the left and the right belt portions can freely pivot with respect to the central support, to accommodate the user's body shape and the user's movement.

2. A backpack as defined in claim 1, wherein the first support panel extends between the left and right pivot axis.

3. A backpack as defined in claim 1, wherein the left pivot axis is disposed closest to a lower edge of the central support and to a lower edge of the left belt portion with respect to a top edge of the central support and a top edge of the left belt portion, and the right pivot axis is disposed closest to a lower edge of the central support and to a lower edge of the right belt portion with respect to a top edge of the central support and a top edge of the right belt portion.

4. A backpack as defined in claim 1, further comprising a framesheet coupled to the first side of the pack body, the framesheet including a lower portion that contributes to the central support.

5. A backpack as defined in claim 1, wherein the left pivot axis is disposed closest to a lower edge of the central support and a lower edge of the left belt portion with respect to a top edge of the central support and a top edge of the left belt portion, and the right pivot axis is disposed closest to a lower edge of the central support and a lower edge of the right belt portion with respect to a top edge of the central support and a top edge of the right belt portion.

6. A backpack, comprising:

a sack configured to be disposed on a user's back and having a first side located adjacent to the user's back, when the backpack is worn;

a load support structure coupled to the first side of the of the sack, having an upper portion adjacent to the user's scapulas, when the backpack is worn;

a waistbelt having a dual-axis canting system, the waistbelt comprising:

central support operatively coupled to the load support structure and disposed in a lower portion of the backpack, wherein the central support includes a first support panel providing structural rigidity and defining two independent pivot points for a left and right belt portions, the first panel disposed outside the pack body, and a second support panel providing structural rigidity and disposed inside the pack body and coupled to the first support panel, capturing a central stay and a portion of the pack body between the first and second support panel, wherein the central stay provides structural rigidity, a left belt portion pivotally coupled to the central support, defining a left pivot axis, the left belt portion configured to extend around a left side of the user, a right belt portion pivotally coupled to the central support, defining a right pivot axis spaced apart from the left pivot axis, the right belt portion configured to extend around a right side of the user, a catch mechanism configured to maintain pivotal movement of the left and the right belt portions within a bounded range, the catch mechanism comprising a pin extending from a belt portion disposed for movement within an arced slot defined by the central support, and wherein the left and the right belt portions can freely pivot with respect to the central support, to accommodate the user's body shape and the user's movement.

7. A backpack as defined in claim 6, wherein the first support panel extends between the left and right pivot axis.

8. A backpack as defined in claim 6, further comprising a pair of shoulder straps, each having an upper end coupled to the upper portion of the load support structure and a lower end coupled to the central support of the waistbelt.

9. A backpack, comprising:

a sack configured to be disposed on a user's back and having a first side located adjacent to the user's back, when the backpack is worn;

a load support structure coupled to the first side of the of the sack, having an upper portion adjacent to the user's scapulas, when the backpack is worn;

a waistbelt having a dual-axis canting system, the waistbelt comprising:

central support operatively coupled to the load support structure and disposed in a lower portion of the backpack, wherein the central support includes a first support panel providing structural rigidity and defining two independent pivot points for a left and right belt portions, the first panel disposed outside the pack body, and a second support panel providing structural rigidity and disposed inside the pack body and coupled to the first support panel, capturing a central stay and a portion of the pack body between the first and second support panel, wherein the central stay provides structural rigidity, a left belt portion pivotally coupled to the central support, defining a left pivot axis, the left belt portion configured to extend around a left side of the user, a right belt portion pivotally coupled to the central support, defining a right pivot axis spaced apart from the left pivot axis, the right belt portion configured to extend around a right side of the user, a left belt portion configured to extend around a left side of the user, the left belt portion having a side panel pivotally coupled to the central support, defining a left pivot axis, and further having a padded sleeve disposed about the side panel, and a right belt portion configured to extend around a right side of the user, the right belt portion having a side panel pivotally coupled to the central support, defining a right pivot axis, and further having a padded sleeve disposed about the side panel, wherein the left and right belt portions can freely pivot with respect to the central support to accommodate the user's body shape and the user's movement; and a pair of shoulder straps, each having an upper end coupled to the upper portion of the load support structure and a lower end coupled to the central support of the waistbelt, and a catch mechanism configured to maintain pivotal movement of the left and the right belt portions within a bounded range, the catch mechanism comprising a pin extending from a belt portion disposed for movement within an arced slot defined by the central support.

10. A backpack as defined in claim 9, wherein the first support panel extends between the left and right pivot axis.

11. A backpack as defined in claim 9, wherein the left pivot axis is disposed closest to a lower edge of the central support and to a lower edge of the left side panel with respect to a top edge of the central support and a top edge of the left side panel, and the right pivot axis is disposed closest to a lower edge of the central support and to a lower edge of the right side panel with respect to a top edge of the central support and a top edge of the right side panel.

12. A backpack as defined in claim 9, wherein the left pivot axis is disposed closest to a lower edge of the first support panel and to a lower edge of the left side panel with respect to a top edge of the first support panel and a top edge of the left side panel, and the right pivot axis is disposed closest to a lower edge of the first support panel and to a lower edge of the right side panel with respect to a top edge of the first support panel and a top edge of the right side panel.

* * * * *